United States Patent [19]

Hulslander et al.

[11] 4,037,826

[45] July 26, 1977

[54] MIXING APPARATUS HAVING PLURALITY OF DIFFERENT BLADES WITH MULTIPLE FUNCTIONS

[75] Inventors: Gary L. Hulslander; Gary E. Mills, both of Portland; David L. Harris, Oregon City, all of Oreg.

[73] Assignee: Dependable-Fordath, Inc., Sherwood, Oreg.

[21] Appl. No.: 679,915

[22] Filed: Apr. 26, 1976

[51] Int. Cl.[2] ..... B01F 7/16

[52] U.S. Cl. ..... 259/8; 259/44

[58] Field of Search ..... 259/7, 8, 5, 6, 23, 259/24, 43, 44

[56] References Cited

U.S. PATENT DOCUMENTS

| | | | |
|---|---|---|---|
| 1,734,632 | 11/1929 | Merrill | 259/43 |
| 3,051,455 | 8/1962 | Magester | 259/8 |
| 3,365,177 | 1/1968 | Damon | 259/23 |
| 3,687,288 | 8/1972 | Lynch | 259/8 |
| 3,779,520 | 12/1973 | Edwards | 259/7 |

FOREIGN PATENT DOCUMENTS

| | | | |
|---|---|---|---|
| 1,037,665 | 8/1966 | United Kingdom | 259/7 |

*Primary Examiner*—Edward J. McCarthy
*Attorney, Agent, or Firm*—Klarquist, Sparkman, Campbell, Leigh, Hall & Whinston

[57] ABSTRACT

A mixing apparatus for mixing particulate material is described in which a plurality of different shaped blades are employed for thorough rapid mixing as the material moves downward through a mixing chamber and for impelling the mixed material downward through a discharge opening at the bottom of such chamber. A pair of convoluted lower mixing blades, which spiral downward and inward, are used to mix, to impel the material downward through the discharge opening, and to scrape such material from the conical bottom surface of the mixing chamber. First and second pairs of longitudinal intermediate mixing blades of different lengths positioned above the convoluted blades mix and scrape the material from the cylindrical side surface of the mixing chamber. A plurality of upper deflector blades are attached to the periphery of an upper baffle plate to deflect the material downward after it is thrown outward from the rotating baffle plate when the material is fed onto such baffle plate through the inlet openings of the mixing apparatus. A pair of separate screw conveyor feeding means are employed to transmit two different materials separately into the mixing chamber. For example, a first material consisting of sand and resin binder and a second material consisting of sand and catalyst for cold setting such binder are fed through two inlet openings in the top of the mixing apparatus which discharge the mixed material into boxes for making molds and cores used in metal casting.

16 Claims, 5 Drawing Figures

MIXING APPARATUS HAVING PLURALITY OF DIFFERENT BLADES WITH MULTIPLE FUNCTIONS

BACKGROUND OF INVENTION

The subject matter of the present invention relates generally to apparatus for mixing particulate material and in particular to such a mixing apparatus employing a plurality of different shaped blades having multiple functions, including mixing, deflecting, scraping and impelling. The present mixing apparatus outwardly deflects and thorougly mixes two different materials rapidly as the materials move downward through a mixing chamber, scrapes and mixed material from the surface of the chamber, and impels the mixed material through a discharge opening at the bottom of such chamber. As a result the mixing apparatus is capable of continuous flow operation for high speed production of mixed material.

The invention is particularly useful in the manufacture of sand molds and cores employed to cast metal objects, for supplying to mold or core forming boxes a mixture of a first material consisting of sand and resin binder and a second material of sand and catalyst for accelerating the curing and cold setting of such binder. These two materials are fed separately into two inlets in the top of the mixing chamber where they are thoroughly and rapidly mixed before being discharged into mold boxes or mold cores where the binder hardens and sets the mixed material to form the molds and cores used for casting.

The mixing apparatus of the present invention is an improvement on the apparatus shown in U.S. Pat. No. 3,934,858 of R. A. Parsonage, granted Jan. 27, 1976. This prior mixing apparatus employs mixing and deflector blades which extend as one solid piece from the central rotating support shaft to their outer edge so that mixed material tends to build up on and adhere to the surfaces of such blades due to their greater area. In addition, the side wall of the mixing chamber is a conical wall which slopes downward and inwardly so that there is also build up of the mixed material on such walls which is not scraped off of the walls by the blades. The mixing apparatus of the present invention overcomes these problems by employing narrow mixing blades which are attached by spaced support rods to the rotating central shaft, including longitudinal mixing blades whose radial width is less than its thickness and which extend along substantially the entire length of the cylindrical inner surface of the side of the mixing chamber to scrape material from such inner surface. Convoluted mixing blades which spiral downward and inward are positioned with the conical bottom portion of the mixing chamber, which also act as impellers, to move the mixed material through the discharge opening, and as scrapers to scrape the conical inner surface of the bottom portion of the mixing chamber. This is an improvement over the longitudinal blades used to scrape the mixing chambers in the continuous mixing apparatus of copending U.S. patent application Ser. No. 595,042 of R. A. Parsonage, filed July 11, 1975, and the batch mixing apparatus of U.S. Pat. No. 3,779,520 of A. Edwards, granted Dec. 18, 1973, which is emptied by compressed air. It should be noted that convoluted mixing blades have been used in other mixing apparatus, such as that of E. D. Abraham, shown in U.S. Pat. No. 3,494,412, granted Feb. 10, 1970, and U.S. Pat. No. 3,637,191, granted Jan. 25, 1972, and of E.A.F. Presser, disclosed in U.S. Pat. No. 2,390,460, granted Dec. 4, 1945, but they do not spiral downward and inward adjacent the conical inner surface of the bottom portion of a mixing chamber so that they can perform the three functions of mixing, impelling, and scraping in the manner of the present invention.

In one embodiment, the mixing apparatus of the present invention supplied 800 pounds of mixed material per minute through the discharge opening while employing a mixture of about 97.9% silica sand of 50 to 75 AFS particle size, a synthetic resin binder of about 1.75% and the remaining 0.35% being catalyst for such binder, the above percentages being given by weight.

SUMMARY OF INVENTION

It is therefore one object of the present invention to provide an improved mixing apparatus for thoroughly mixing particulate material rapidly which prevents the mixed material from adhering to the mixing blades and to the inner surface of the mixing chamber.

Another object of the present invention is to provide such a mixing apparatus for mixing a first material of said and resin binder and a second material of sand and a catalyst for such binder which is capable of continuously flowing, mixing, and discharging the mixed material as it is being fed to enable the rapid production of high quality sand molds or cores for casting.

A further object of the invention is to provide such a mixing apparatus which employs a plurality of different shaped blades which are mounted on a rotating shaft in the mixing chamber and have multiple functions including deflecting, mixing, scraping, and impelling functions.

An additional object of the present invention is to provide such a mixing apparatus employing lower convoluted mixing blades which spiral downward and inward to mix and impel the material downward through the discharge openings of the mixing chamber and which also scrape the conical inner surface of the bottom portion of such chamber.

Still another object of the present invention is to provide such a mixing apparatus employing longitudinal mixing blades which mix and simultaneously scrape material from the cylindrical inner surface of the side portion of the mixing chamber above such convoluted blades.

A still further object of the invention is to provide such a mixing apparatus employing an upper baffle plate and a plurality of deflector plates supported on such baffle plate and uniformly spaced about the periphery thereof to downwardly deflect the material to be mixed after it is thrown outward by the rotating baffle plate onto which such material is fed.

BRIEF DESCRIPTION OF DRAWINGS

Other objects and advantages of the present invention will be apparent from the following description of a preferred embodiment thereof and from the attached drawings of which.

DESCRIPTION OF PREFERRED EMBODIMENT

Figure 1:
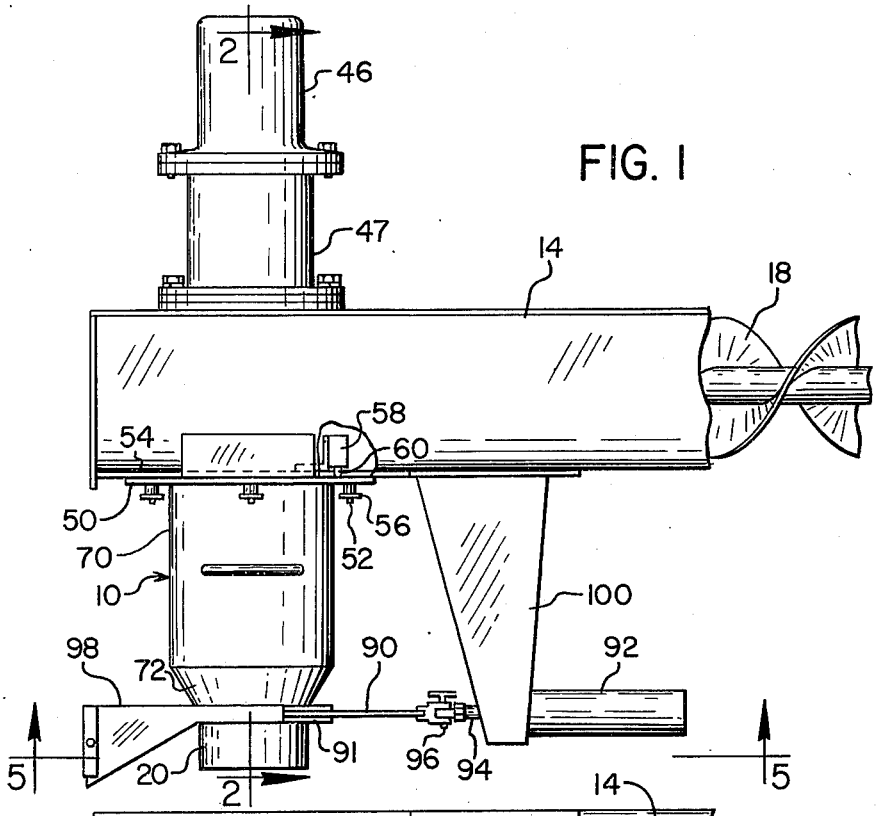
FIG. 1 is a side elevation view of one embodiment of the mixing apparatus of the present invention with parts broken away for clarity.
Figure 2:
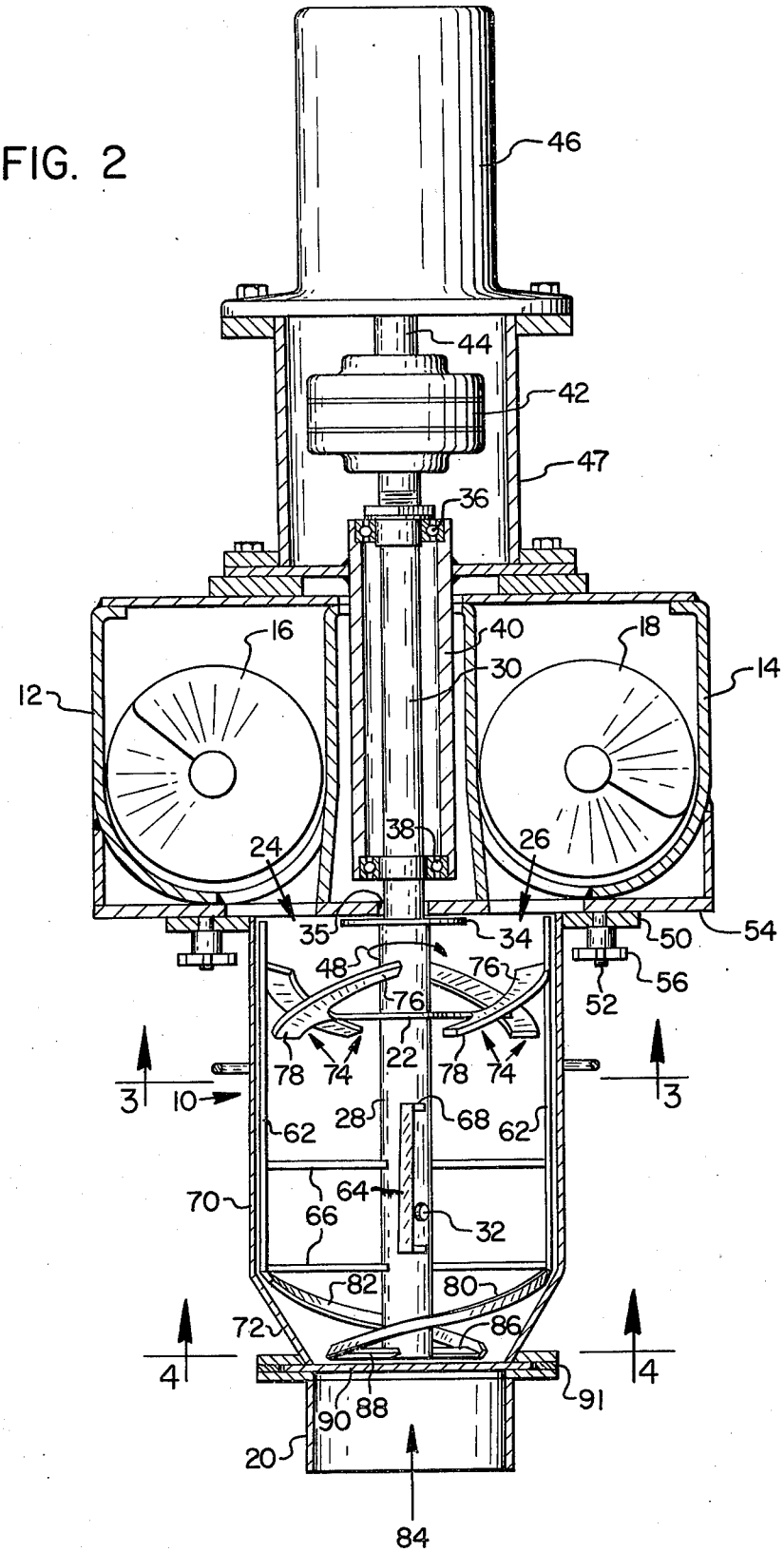
FIG. 2 is an enlarged vertical section view taken along the line 2—2 of FIG. 1.

As shown in FIGS. 1 and 2, the mixing apparatus of the present invention includes a mixing chamber 10 which is supplied with two separate materials to be mixed thoroughly, by a pair of feeder conduits 12 and 14. The feeder conducts may each contain a screw type feeder conveyor 16 and 18 of conventional type, such as that shown in U.S. Pat. No. 3,779,520, referred to previously. After mixing the mixed material is transmitted from the bottom of the mixing chamber 10 through a discharge chute 20 into the mold box or core box for forming the sand mold or sand core used for casting.

Screw conveyor 18 is rotated in a counterclockwise direction while screw conveyor 16 is rotated in a clockwise direction in FIG. 2 to discharge the materials being mixed onto the central portion of a rotary baffle plate 22 which is positioned within the mixing chamber 10 beneath two inlet openings 24 and 26 at the top of such chamber. The screw conveyors are both rotated at the same speed of, for example, about 85 RPM by an electric motor, not shown.

The baffle plate 22 is attached to a hollow rotor shaft 28 extending coaxially through the center of the mixing chamber 10 and connected to a drive shaft 30 extending into the rotor shaft by a pin 32 which extends through openings in the sides of both shafts 28 and 30 to couple them together. An annular flange 34 at the top of the rotor shaft 28 closes an opening 35 in the cover of the mixing chamber through which the drive shaft 30 extends to prevent mixed material from exiting through such opening. The drive shaft 30 is mounted in a pair of rotary bearings 36 and 38, secured inside the opposite ends of a support sleeve 40. The upper end of the drive shaft 30 is connected through a coupling 42 to the output shaft 44 of an electric motor 46. The electric motor may be a 10 horsepower motor which rotates shafts 44, 30, and 28 at a speed of about 420 RPM. Coupling 42 is contained within a dust proof housing 47 secured to bearing sleeve 40. The mixer shaft 28 rotates in the direction of arrow 48 which is clockwise looking from the bottom of the mixer chamber, as shown in FIG. 4.

The mixing chamber 10 is provided with an outer mounting flange 50 at the upper end thereof which is provided with a plurality of openings through which four threaded studs 52 extend. One end of the studs is fixedly secured to the bottom of a support plate 54 welded to the bottom of the two feeder conduits 12 and 14, while the other end of the studs is secured to threaded hand knobs 56, which clamp the flange 50 and mixing chamber 10 to such support plate. A safety switch 58 is mounted on the support plate 54 so that its actuating member 60 is operated by contact with the mounting flange 50 when the mixing chamber is mounted on the support plate. This switch 56 disables the operation of the mixer motor 46 and the motor for the two screw conveyors when the mixing chamber 10 is removed from support plate 54 for any reason, such as cleaning purposes. It should be noted that the inlet openings 24 and 26 at the top of the mixing chamber are actually formed by openings in the mounting plate 54 extending as a cover over the top of such chamber.

As shown in FIG. 2, the mixing chamber 10 contains a first pair of longitudinal mixing blades 62 and a second pair of longitudinal mixing blades 64 which are attached by spaced support arms 66 and 68, respectively, to the rotor shaft 28. The first longitudinal mixing blades 62 extend along the entire length of the cylindrical inner surface of a cylindrical side portion 70 of the mixing chamber and are uniformly spaced a short distance from such inner surface. Thus, blades 62 extend from the top of such chamber adjacent flange 34 to the bottom of the cylindrical side portion where it joins with a conical bottom portion 72 of the mixing chamber. The second longitudinal mixing blades 64 are shorter than blades 62 and extend only a distance equal to approximately one-half the length of the cylindrical side portion 70 of the mixing chamber. These second longitudinal mixing blades 64 are spaced approximately 90° from the first longitudinal mixing blades 62 and are uniformly spaced from the cylindrical inner surface of the side portion 70 of the mixing chamber. Both of the pairs of blades 62 and 64 may be spaced a distance of approximately one-quarter of an inch from the inner surface of the cylindrical side portion of the mixing chamber to enable both to function to scrape mixed material from such inner surface, as well as mix the material within such chamber.

Figure 4:
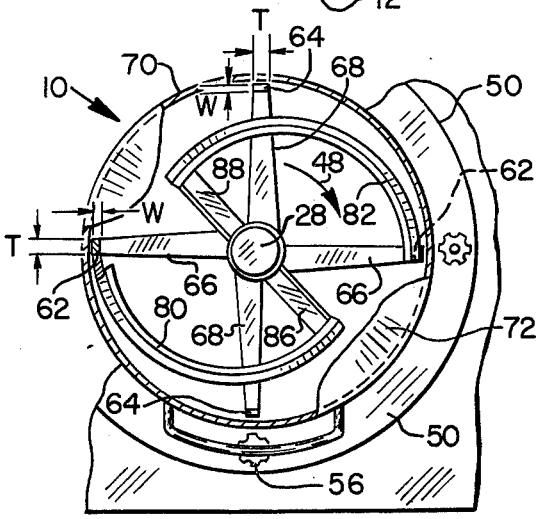
FIG. 4 is a horizontal section view taken along the line 4—4 of FIG. 2 with parts broken away for clarity.

As shown in FIG. 4, the radial width W of the first and second longitudinal mixing blades 62 and 64 is less than the thickness T of such blades, such width being typically one quarter inch and such thickness being typically one-half inch. As a result of using such narrow mixing blades 62 and 64 and the fact that such blades are supported by spaced support arms 66 and 68 on the rotor shaft, very little mixed material sticks to such blades. Also, the scraping action of the blades prevents material build up on the interior surface of the mixing chamber.

The baffle plate 22 is connected to four deflector blades 74 which are attached at uniformly spaced positions about the outer periphery of the baffle plate and may be formed integrally therewith. The blades 74 are bent so that they extend at an acute angle of approximately 25° with respect to the plane of the baffle plate 22 with the longer front portion 76 of such blades extending above the baffle plate while the shorter rear portion 78 of the blades extends below the baffle plate. Two of the deflector blades have their front portions 76 welded to the first longitudinal mixing blades 62 spaced at the top thereof to provide additional support.

Mixing material fed through inlet openings 24 and 26 onto the rotating baffle plate 22 is thrown outwardly by such baffle plate against the bottom of the front portion 76 of the deflector blades and deflected downwardly by such blades to enable such material to be thoroughly mixed by the longitudinal mixing blades 62 and 64. It should be noted that the baffle plate 22 prevents mixing material from traveling down the outer surface of rotor shaft 28 where it would not be thoroughly mixed.

The outer surface of the longitudinal mixing blades 62 and 64 as well as the leading edge of such blades and the outer surface of the deflector blades 74 positioned closely adjacent to the cylindrical inner surface of the mixing chamber may be coated with a flame sprayed wear resistant material, such as a metal alloy containing tungsten carbide.

As shown in FIGS. 2 and 4, a pair of lower convoluted mixing blades 80 and 82 are provided within the mixing chamber beneath the longitudinal mixing blades 62 and 64. The convoluted mixing blades spiral downwardly and inwardly in the manner of a corkscrew and as a result impel the mixed material downward through the discharge opening in the bottom of the mixing chamber during rotation of such blades. The convoluted mixing blades are of substantially uniform width, W, along their length, and have their upper ends attached to the bottoms of the first longitudinal mixing blades 62 and have their lower ends attached to the outer ends of a pair of impeller blades 86 and 88. The impeller blades 86 and 88 extend radially outward from the rotor shaft 28 and are spaced apart approximately 180°.

The convoluted mixing blades 80 and 82 are provided with an outer surface which extends at an angle of approximately 30° with respect to the vertical and in this regard conforms to the angle of the conical bottom portion 72 of the mixing chamber. The convoluted mixing blades 80 and 82 are spaced from the conical inner surface of such bottom portion by approximately one-quarter of an inch and also function to scrape material from such conical inner portion to prevent material build up on the surface of the mixing chamber. For this reason, the outer surface and the leading edge of the convoluted mixing blades 80 and 82 may also be coated with a wear resistant material. Thus, convoluted mixing blades 80 and 82 perform three functions: mixing, scraping, and impelling the mixed material downward due to their spiral shape. The impeller blades 86 and 88 are provided with a 20° pitch on their lower surface so they also act to impel the mixed material to the discharge opening 84 at the bottom of the mixing chamber.

Figure 5:
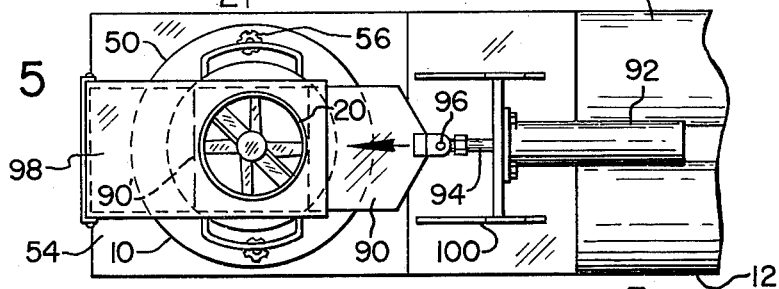
FIG. 5 is a horizontal elevation view taken along the line 5—5 of FIG. 1.
Figure 3:
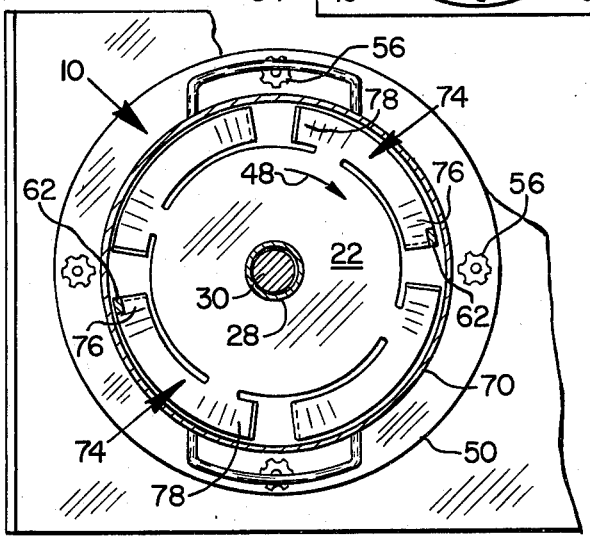
FIG. 3 is a horizontal section view taken along the line 3—3 of FIG. 2.

As shown in FIGS. 1, 2, and 5, a sand gate in the form of a flat metal plate 90 is supported for sliding movement at the bottom of the mixing chamber to selectively cover the discharge opening 84. The sand gate slides within a guide 91 positioned between the discharge chute 20 and the conical bottom portion 72 of the mixing chamber. The sand gate 90 is operated by a pneumatic cylinder 92 whose output piston rod 94 is connected by a pivoted connection 96 to one end of the sand gate. A sand gate guard 98 is provided over the guide on the front of the mixing chamber to prevent injury to an operator when the sand gate is inserted into its closed position 90' to the left from the open position 90 shown in FIG. 1. Also the actuating cylinder 92 is supported on a cylinder bracket 100 whose upper end is attached to the support plate 54 beneath the feeder conduits. It should be noted that the spacing between the impeller blades 86 and 88 to the top of sand gate plate 90 is on the order of about 1/32 of an inch or less and such blades completely remove any mixed material which tends to be deposited thereon.

A typical operation of the mixing apparatus of the present invention involves first closing the sand gate 90 and then starting the mixing motor 46 as well as the motor controlling the screw conveyor feed means 16 and 18. The mixing chamber is operated in this condition for approximately 3 to 4 seconds to obtain thorough mixing. Then the sand gate is opened and the mixing apparatus is operated in a continuous flow mode in which the material is continuously fed into the top of the mixing chamber and discharged from the bottom thereof into mold boxes or the like. When all mold boxes are filled, the mixing chamber must be emptied by continuing to operate the mixing motor 46 after the screw conveyor feed motor is deenergized. After the mixing chamber is emptied, it may be cleaned out by the use of water or compressed air in a conventional manner.

It will be obvious to those having ordinary skill in the art that many changes may be made in the above described details of the preferred embodiment of the present invention without departing from the spirit of the invention. For example, the baffle plate 22 and the deflector plates 74 may be formed as two separate members attached to the rotor 28. Therefore, the scope of the present invention should only be determined by the following claims.

We claim:

1. Mixer apparatus comprising:

mixing chamber means having a discharge opening at its lower end;

feeder means for introducing the materials to be mixed into the upper end of said chamber;

a rotatable shaft extending centrally through said chamber;

means for rotating said shaft; and a plurality of blades fixed to said shaft within said chamber including convoluted mixing and impelling blades which spiral downward and inward to cause the spacing between said mixing blades and said shaft to decrease with distance along said shaft so that said mixing blades mix said materials and impel the mixed materials downward through said discharge opening when said shaft is rotated, and including longitudinal mixer blades fixed to said shaft above said convoluted mixing blades.

2. Mixer apparatus in accordance with claim 1 in which the top ends of the convoluted mixing blades are attached to the bottom ends of first longitudinal mixer blades fixed to said shaft by spaced support arms and extending longitudinally along a cylindrical inner surface of the side of said chamber to the top end of said chamber to mix said material and scrape it from said inner surface during rotation of said shaft.

3. Mixer apparatus in accordance with claim 1 in which the bottom ends of the convoluted mixing blades are attached to the outer ends of downwardly pitched impeller blades whose inner ends are fixed to said shaft and which extend laterally of said shaft above said discharge opening to impel said material down through said discharge opening.

4. Mixer apparatus in accordance with claim 3 in which a sliding gate is mounted for sliding movement between open and closed positions over the discharge opening to cover said opening when said gate is closed, said gate being closely spaced from said impeller blades so that they also scrape said material from the gate in its closed position.

5. Mixer apparatus in accordance with claim 2 which also includes a plurality of second longitudinal mixer blades fixed to said shaft by other spaced support arms and extending longitudinally of said shaft, said second longitudinal mixer blades being shorter than said first longitudinal mixer blades.

6. Mixer apparatus in accordance with claim 5 in which the first and second longitudinal mixer blades are arranged in diametrically opposed pairs of blades of the same length.

7. Mixer apparatus in accordance with claim 5 in which the first and second longitudinal mixer blades have a radial width which is less than the thickness of such blades to prevent said material from adhering thereto.

8. Mixer apparatus in accordance with claim 1 which also includes a baffle plate fixed to said shaft for rotation within said chamber beneath the outlets of said feeder means at the top end of said chamber so that the material is fed onto said baffle plate and thrown outward by the rotating baffle plate, said baffle plate having deflector blades attached to the periphery thereof and extending at an acute angle to said baffle plate for deflecting the material.

9. Mixer apparatus in accordance with claim 8 in which the deflector blades are arcuate members formed integral with the baffle plate and deflect the material downward.

10. Mixer apparatus in accordance with claim 8 in which at least some of said deflector blades are attached at their outer edges to the top ends of a plurality of first longitudinal mixer blades fixed to said shaft and extending longitudinally along the inner surface of said chamber.

11. Mixer apparatus in accordance with claim 1 which also includes first longitudinal mixer blades extending longitudinally along the inner surface of the side of said chamber, second longitudinal mixer blades extending longitudinally along said shaft and of shorter length than said first blades, and deflector blades extending radially outward from said shaft beneath the outlet of said feeder means for deflecting the material outward and downward, said blades all being fixed to said shaft for rotation therewith, and said first and second mixer blades being positioned between said deflector blades and said convoluted mixing blades.

12. Mixer apparatus in accordance with claim 11 in which the chamber includes a cylindrical side portion extending along said deflector blades, and said first and second mixer blades, and also includes a conical bottom portion extending along the convoluted mixing blades to said discharge opening so that said convoluted mixing blades scrape material from the inner surface of said conical bottom portion.

13. Mixer apparatus, comprising:

mixing chamber means having a discharge opening at its lower end;

feeder means for introducing the materials to be mixed into the upper end of said chamber;

a rotatable shaft extending centrally through said chamber;

means for rotating said shaft; and a plurality of blades fixed to said shaft within said chamber including first longitudinal mixer blades fixed to said shaft by spaced support arms and extending longitudinally along substantially the entire length of a cylindrical inner surface of the side of said chamber to mix said material and scrape it from said inner surface during rotation of said shaft, and including other blade means for directing the material outward away from the shaft toward said mixer blades.

14. Mixer apparatus in accordance with claim 13 which also includes a plurality of second longitudinal mixer blades fixed to said shaft by other spaced support arms and extending longitudinally of said shaft, said second longitudinal mixer blades being shorter than said first longitudinal mixer blades.

15. Mixer apparatus in accordance with claim 14 which also includes a baffle plate fixed to said shaft for rotation within said chamber beneath the outlets of said feeder means at the top end of said chamber, so that the material is fed onto said baffle plate and thrown outward by the rotating baffle plate, said baffle plate having deflector blades attached to the periphery thereof and extending at an acute angle to said baffle plate for deflecting the material.

16. Mixer apparatus in accordance with claim 1 in which the convoluted mixing blades are of a substantially uniform width along the length of said blades.

* * * * *